US009277790B2

(12) United States Patent
Hayashi et al.

(10) Patent No.: US 9,277,790 B2
(45) Date of Patent: Mar. 8, 2016

(54) FASTENER STRINGER AND FASTENER CHAIN

(75) Inventors: Akio Hayashi, Toyama (JP); Kanae Maruoka, Toyama (JP); Takeshige Kurata, Toyama (JP); Aya Takamoto, Toyama (JP)

(73) Assignee: YKK Corporation (JP)

( * ) Notice: Subject to any disclaimer, the term of this patent is extended or adjusted under 35 U.S.C. 154(b) by 178 days.

(21) Appl. No.: 13/994,858

(22) PCT Filed: Dec. 17, 2010

(86) PCT No.: PCT/JP2010/072781

§ 371 (c)(1),
(2), (4) Date: Jun. 17, 2013

(87) PCT Pub. No.: WO2012/081123

PCT Pub. Date: Jun. 21, 2012

(65) Prior Publication Data

US 2014/0215771 A1 Aug. 7, 2014

(51) Int. Cl.
*A44B 19/34* (2006.01)
*A44B 19/46* (2006.01)

(52) U.S. Cl.
CPC ..... *A44B 19/34* (2013.01); *A44B 19/46* (2013.01); *Y10T 24/25* (2015.01); *Y10T 29/49984* (2015.01)

(58) Field of Classification Search
CPC ..... A44B 19/00; A44B 19/02; A44B 19/04; A44B 19/06; A44B 19/08; A44B 19/10; A44B 19/12; A44B 19/34; A44B 19/346; A44B 19/42; A44B 19/24; A44B 19/40; A44B 19/403; A44B 19/32; A44B 19/46
USPC ..... 24/381
See application file for complete search history.

(56) References Cited

U.S. PATENT DOCUMENTS 4,172,702 A * 10/1979 Bernier ..... B05D 7/14 427/195
4,251,582 A * 2/1981 Bernier et al. ..... 428/99
(Continued)

FOREIGN PATENT DOCUMENTS

JP 4-24004 A 1/1992
JP 2002-187340 A 7/2002
(Continued)

OTHER PUBLICATIONS

International Search Report, PCT Application No. PCT/JP2010/072781, mailed Mar. 29, 2011.
(Continued)

*Primary Examiner* — Robert J Sandy
*Assistant Examiner* — Rowland Do
(74) *Attorney, Agent, or Firm* — Kilpatrick Townsend & Stockton LLP

(57) ABSTRACT

The fastener stringer is arranged with at least one printable resin layer to which ink can be fixed on the entire surface of fastener elements. Printing by an inkjet method is carried out at least on the exposed surfaces exposed on the first tape surface side in the tape front- and back direction of the fastener elements, the inner surfaces of the first tape surface side facing the tape inward side, along with the first tape surface of the fastener tape. A desired pattern can thereby be stably formed not only on the fastener tape and the exposed surfaces of the fastener elements, but can also be formed on the inner surfaces of the fastener elements. Therefore, a pattern can be formed in a continuous manner on the fastener tape and the fastener elements, and decorativeness and design unattainable in the past can be obtained.

11 Claims, 5 Drawing Sheets

(56) References Cited

U.S. PATENT DOCUMENTS

| | | | | |
|---|---|---|---|---|
| 4,765,038 | A * | 8/1988 | Kasai | A44B 19/06 24/389 |
| 5,020,206 | A * | 6/1991 | Yoshida et al. | 29/408 |
| 5,042,117 | A * | 8/1991 | Tsubata | 24/381 |
| 5,417,249 | A * | 5/1995 | Kato | 139/384 B |
| 6,427,294 | B1 * | 8/2002 | Shibaike | A44B 19/32 24/381 |
| 6,442,804 | B2 * | 9/2002 | Turvey et al. | 24/399 |
| 8,667,652 | B2 * | 3/2014 | Thomas et al. | 24/389 |
| 2003/0000051 | A1 * | 1/2003 | Aoshima et al. | 24/415 |
| 2003/0093885 | A1 * | 5/2003 | Inoue et al. | 24/381 |
| 2003/0139294 | A1 * | 7/2003 | Suh | 503/227 |
| 2004/0111842 | A1 * | 6/2004 | Imai | 24/381 |
| 2004/0237266 | A1 * | 12/2004 | Wang | 24/389 |
| 2005/0217085 | A1 * | 10/2005 | Lu | 24/381 |
| 2006/0016051 | A1 * | 1/2006 | Wang et al. | 24/389 |
| 2007/0094852 | A1 * | 5/2007 | Wang | A44B 19/32 24/389 |
| 2007/0143971 | A1 * | 6/2007 | Ho | 24/398 |
| 2007/0270308 | A1 * | 11/2007 | Yokoyama et al. | 503/201 |
| 2009/0276985 | A1 * | 11/2009 | Kim | 24/431 |
| 2013/0019442 | A1 * | 1/2013 | Yamakita | A44B 19/06 24/431 |
| 2015/0033512 | A1 * | 2/2015 | Kojima | A44B 19/06 24/430 |

FOREIGN PATENT DOCUMENTS

| | | | |
|---|---|---|---|
| JP | 3128307 | U | 1/2007 |
| JP | 2008-105207 | A | 5/2008 |
| JP | 2008-195030 | A | 8/2008 |
| WO | 2010/082291 | A1 | 7/2010 |

OTHER PUBLICATIONS

Supplementary Search Report, European Patent Application No. 10860677.3, mailed Jul. 20, 2015.

* cited by examiner

FASTENER STRINGER AND FASTENER CHAIN

This application is a national stage application of PCT/JP2010/072781 which is incorporated herein by reference.

TECHNICAL FIELD

The invention relates to a fastener stringer and a fastener chain in which a plurality of metallic fastener elements is attached to a tape side edge portion of a fastener tape and printing by an inkjet method is carried out, and a method for manufacturing the fastener chain.

BACKGROUND ART

In general, a slide fastener is manufactured by configuring a fastener stringer by attaching a synthetic resin or a metal fastener element to an opposing side edge portion of a woven or knitted fastener tape, and further, to one set of two fastener stringers that are obtained, a slider is slidably attached to element rows of left and right fastener stringers. In the slide fastener, the opposing fastener elements are coupled with and separated from each other by sliding the slider along the element rows.

Conventionally, various designs have been carried out in clothes or bags using the slide fastener, and further, new designs are required in order to further enhance values of products. Further, in recent years, design has been required even in the slide fastener used in the clothes or bags, and the fastener tape or the fastener element having various patterns or colors have come into the market.

As a method of applying a pattern or a color to the fastener tape or the synthetic resin fastener element, for example, a method is known, in which a heat transfer sheet having a predetermined pattern is attached to the fastener tape and the synthetic resin fastener element in a state of a fastener chain, and thereafter, heat treatment is applied to the fastener chain and thus the pattern is transferred to the fastener stringer.

Further, for example, JP 4-24004 A (Patent Document 1) discloses a method and an apparatus of dyeing a slide fastener by an inkjet method.

In the method of dyeing the slide fastener disclosed in Patent Document 1, an ink droplet is ejected from a nozzle head onto one surface of a fastener chain to which a synthetic resin fastener element is attached to print a desired pattern on the fastener tape and the fastener element, and thereafter, heat treatment is applied to the fastener chain printed with the pattern to dye a dye to the fastener tape and the fastener element.

In particular, in Patent Document 1, the fastener element fixed to the fastener tape is configured by using a synthetic resin of the same type as the fastener tape. As a result, by carrying out printing by the inkjet method, a pattern which is formed in a continuous manner from one tape surface of the fastener tape to the other tape surface of the fastener tape through the surface of the fastener element can be applied to the fastener chain.

In general, when the printing by the inkjet method is carried out on articles made of metal, leather, hard rubber, or the like, ink attached to the surface of the article does not permeate or is not applied on the surface due to the material of the article. As a result, for example, when a printing surface by the inkjet method contacts or grazes the other member, the ink is easily separated from the surface, and as a result, durability of a printed pattern is low.

In order to solve the above problem, for example, JP 2002-187340 A (Patent Document 2) discloses a printing method that improves durability of a printed pattern.

To briefly describe the printing method disclosed in Patent Document 2, first, cleaning process is carried out on the surface of an article to be printed, and a primer layer as an adhesive layer is formed on the cleaned surface. In Patent Document 2, a material of the primer layer is not defined in detail.

Subsequently, an undercoat liquid is ejected or applied onto the primer layer to form an undercoat layer, and printing by aqueous ink is carried out on the undercoat layer. Further, after a printing surface attached with the aqueous ink is dried, a transparent top coat layer is formed at least on an entire printing surface.

By using the printing method of Patent Document 2, for example, the printing by the inkjet method can be carried out on the article made of the metal, leather, hard rubber, and the like, and further, high durability is obtained with respect to the pattern printed onto the article.

PRIOR ART DOCUMENT

Patent Document

Patent Document 1: JP 4-24004 A
Patent Document 2: JP 2002-187340 A

DISCLOSURE OF THE INVENTION

Problem to be Solved by the Invention

For example, in a case where a synthetic resin fastener element is attached to a fastener tape to configure a fastener chain (in particular, in a case where the fastener element is made of the synthetic resin of the same type as the fastener tape), by coloring the fastener tape and the fastener element in the state of the fastener chain by using the inkjet method described in Patent Document 1, as a result, dyes are dyed to both the fastener tape and the fastener element to print a desired pattern onto the fastener chain.

However, for example, in a case where a metallic fastener element is attached to the fastener tape to configure the fastener chain, ink is not fixed onto a surface of the metallic fastener element even though the printing by the inkjet method is carried out on the fastener chain. Therefore, for example, when a printing surface contacts other members or is washed, ink is easily separated from the surface of the fastener element.

Meanwhile, the printing method disclosed in Patent Document 2 is a method of printing a pattern having excellent durability on a flat surface of an article. As a result, for example, in a case where the printing method of Patent Document 2 is used for an article having a stereoscopic form like the slide fastener or the fastener chain where the fastener element largely protrudes in a tape front and back direction with respect to a tape surface of the fastener tape, it is very difficult to appropriately form a primer layer which becomes an adhesive layer or an undercoat layer where printing is carried out, on an entire stereoscopic surface of the article.

Therefore, even though the printing by the inkjet method is carried out on the stereoscopic article by using the printing method of Patent Document 2, ink is only fixed onto a partial surface of the stereoscopic surface where the undercoat layer is formed, or a pattern is interrupted at a stepped surface forming a height difference with respect to a nozzle head, and as a result, a continuous pattern cannot be stably applied to the entire stereoscopic surface.

The present invention was made in view of the above problems, and an object of the invention is to provide a fastener stringer and a fastener chain in which printing by an inkjet method is carried out and a desired pattern is applied to a metallic fastener element together with a fastener tape, and a manufacturing method of the fastener chain.

Means for Solving the Problems

In order to achieve the object, as a basic configuration, a fastener stringer of the invention is most mainly characterized in that; a plurality of metallic fastener elements is attached to a tape side edge portion of a fastener tape and printing by an inkjet method is carried out at least on a first tape surface side of the fastener tape and the fastener element; at least one printable resin layer which is capable of fixing ink is arranged on an entire surface of the fastener element; and the printing by the inkjet method is carried out at least on the first tape surface side of the fastener tape, an exposed surface which is exposed to the first tape surface side in a tape front and back direction of the fastener element and an inner side surface facing a tape inward side.

In particular, it is preferable that the printable resin layer is made of an acrylic resin or an acryl-urethane resin.

In the fastener stringer according to the invention, it is preferable that an adhesive layer arranged on the entire surface of the fastener element is provided between a metal body of the fastener element and the printable resin layer or on the surface of the printable resin layer. In this case, it is preferable that the adhesive layer is made of an epoxy resin.

Further, in the fastener stringer of the invention, it is preferable that an auxiliary resin layer for improving fixability of ink is arranged at least on the printable resin layer of the exposed surface in the fastener element. In this case, it is preferable that the auxiliary resin layer is made of the acrylic resin or the acryl-urethane resin.

In addition, in the fastener stringer of the invention, it is referable that a protective layer is arranged at least on an outermost layer of the exposed surface in the fastener element.

Furthermore, it is preferable that the metal body of the fastener element includes a base portion of the fastener element and a plated layer arranged on a surface of the base portion and having a color with higher reflectivity than the base portion. In this case, it is preferable that the plated layer is formed by an alloy layer of copper, tin, and zinc.

Further, according to the invention, a fastener chain including a pair of left and right fastener stringers provided with the above configuration is provided.

Subsequently, as a basic configuration, a manufacturing method of a fastener chain provided by the invention is most mainly characterized in that it is a method of manufacturing a fastener chain colored with a desired color by carrying out printing by an inkjet method to a fastener chain including left and right fastener stringers in which a plurality of metallic fastener elements is attached to tape edge portions facing a pair of fastener tapes, including processes of: forming at least one printable resin layer which is capable of fixing ink on an entire surface of the fastener element; caulking the plurality of fastener elements where the printable resin layer is formed to the fastener tape; assembling the fastener chain by coupling the fastener elements of the left and right fastener stringers with each other; and carrying out the printing by the inkjet method on a first tape surface of the fastener tape, an exposed surface exposed to the first tape surface side in a tape front and back direction of the fastener element, and an inner side surface of the first tape surface side facing a tape inward side.

It is preferable that the manufacturing method of the fastener chain of the invention includes ejecting ink from a nozzle head to be inclined in an advance direction of the nozzle head with respect to a directly downward direction while making the nozzle head reciprocate in a tape width direction with respect to the fastener chain when printing by the inkjet method.

Further, it is preferable that the manufacturing method of the fastener chain of the invention includes a process of forming an adhesive layer on an entire surface of the fastener element before forming the printable resin layer or after forming the printable resin layer.

In addition, it is preferable that the manufacturing method of the fastener chain of the invention includes a process of forming an auxiliary resin layer on the exposed surface of the fastener element after forming the printable resin layer and before carrying out the printing by the inkjet method.

Furthermore, it is preferable that the manufacturing method of the fastener chain of the invention includes a process of forming a protective layer on the exposed surface of the fastener element after carrying out the printing by the inkjet method.

Further, it is preferable that the manufacturing method of the fastener chain of the invention includes a process of forming a plated layer having a color with higher reflectivity than a base portion on the surface of the base portion of the fastener element.

Effect of the Invention

In the fastener stringer according to the invention, at least one printable resin layer is arranged on an entire surface of a metallic fastener element attached to a fastener tape. As a result, when the printing by an inkjet method is carried out on the metallic fastener element, ink is stably fixed onto the printable resin layer of the fastener element.

Therefore, in the fastener stringer of the invention, a desired pattern may be formed not only on a first tape surface of the fastener tape and an exposed surface at the first tape surface side of the fastener element, but the desired pattern is also stably formed on an inner side surface (a side surface of a tape inward side) at the first tape surface side of the fastener element.

As a result, even if the fastener stringer of the invention is configured as a stereoscopic form having a step between the fastener tape and the fastener element, since for example the pattern can be formed in a continuous manner on the fastener tape and the fastener element, a design range of the slide fastener is expanded and decorativeness and design unattainable in the prior art can be obtained.

In this case, when a printable resin layer arranged on the fastener element is made of an acrylic resin or an acryl-urethane resin, ink ejected from the nozzle head can be stably fixed onto the printable resin layer.

The above fastener stringer of the invention has an adhesive layer which is preferably made of an epoxy resin arranged on the entire surface of the fastener element, provided between a metal body of the fastener element and the printable resin layer, or on the surface of the printable resin layer. As a result, adhesiveness between the metal body of the fastener element and the printable resin layer can be improved, or adhesiveness between the printable resin layer and another layer arranged on the surface of the printable resin layer can be improved.

Therefore, the printing pattern carried out on the fastener element can be effectively prevented from being peeled off.

In this case, an auxiliary resin layer for improving fixability (dyeability) of ink which is preferably made of the acrylic resin or the acryl-urethane resin is arranged at least on the printable resin layer of the exposed surface in the fastener element. As a result, a substantial thickness of the printable resin layer including the auxiliary resin layer increases to more reliably fix ink onto the printable resin layer (auxiliary resin layer) of the exposed surface. Accordingly, the desired pattern can be clearly and stably formed on the exposed surface of the fastener element which easily noticeable when the fastener stringer is viewed from a front side (the first tape surface side of the fastener tape).

Further, in the fastener stringer of the invention, a protective layer is arranged at least on an outermost layer of the exposed surface in the fastener element. As a result, since the fastener element itself can be protected or the pattern applied to the fastener element can be protected, the metal body of the fastener element or the printable resin layer can be prevented from being scratched and the durability of the printed pattern can be improved.

In addition, in the fastener stringer of the invention, the metal body of the fastener element includes a base portion made of a raw material of the fastener element, and the plated layer arranged on the surface of the base portion and having a color with higher reflectivity than the base portion. In particular, the plated layer is made of an alloy of copper, tin, and zinc. As such white-based or silver-based plated layer, which has the higher reflectivity than the base portion of the fastener element is arranged, as a result, the selection range of the color used when printing the fastener element can be expanded and the printing pattern carried out on the fastener element can be more clearly viewed.

Further, in the slide fastener of the invention having a pair of left and right fastener stringers having the above configuration, ink is stably fixed onto the printable resin layer of the fastener element and the desired pattern is stably formed on the first tape surface of the fastener tape and at least on the exposed surface and the inner side surface at the first tape surface side of the fastener element.

As a result, in the slide fastener of the invention, for example, since the pattern can be formed in a continuous manner from the fastener tape of one fastener stringer to the fastener tape of the other fastener stringer through the left and right fastener elements which are coupled with each other, the decorativeness and design unattainable in the prior art can be obtained.

Subsequently, in a manufacturing method of the fastener chain according to the invention, first, a process of forming at least one printable resin layer onto which ink can be fixed on the entire surface of the fastener element is carried out. In this process, for example, a plurality of fastener elements is input into a large container (barrel), and a synthetic resin material (paint) is ejected to the fastener element while rotating the fastener element in the container. As a result, the printable resin layer is formed on the entire surface of the fastener element.

Subsequently, a process of caulking the plurality of fastener elements on which the printable resin layer is formed onto the fastener tape is carried out, and as a result, the fastener stringer is configured. Continuously, the obtained fastener stringers are prepared as one set of left and right stringers, and a process of coupling the fastener elements of the left and right fastener stringers with each other is carried out, and as a result, the fastener chain is assembled.

Thereafter, in at least the first tape surface side of the assembled fastener chain, a process of printing by the inkjet method is carried out on the fastener tape, and the exposed surface and the inner side surface of the fastener element, and the desired pattern is formed on the fastener chain.

According to the manufacturing method of the fastener chain of the invention which includes the above processes, since ink can be stably fixed onto the printable resin layer of the fastener element when the printing by the inkjet method is carried out on the fastener chain, the desired pattern can be stably formed on the first tape surface of the fastener tape, and at least on the exposed surface and the inner side surface at the first tape surface side of the fastener element.

As a result, for example, since the pattern can be formed on the fastener chain in a continuous manner from the fastener tape of the one fastener stringer from the fastener tape of the other fastener stringer through the left and right fastener elements which are coupled with each other, the fastener chain having decorativeness and design unattainable in the prior art can be manufactured.

In the manufacturing method of the fastener chain of the invention, when the printing by the inkjet method is carried out, the nozzle head reciprocates with respect to the fastener chain in the width direction of the tape, and ink is ejected from the nozzle head to be inclined in the advance direction of the nozzle head with respect to the directly downward direction from the nozzle head. As a result, since the ink can be reliably ejected and fixed onto the inner side surface of the fastener element, the printing pattern can be prevented from being discontinuous between the fastener tape and the fastener element and stably applied to the fastener chain.

Further, the manufacturing method of the fastener chain of the invention includes a process of forming the adhesive layer on the entire surface of the fastener element before forming the printable resin layer or after forming the printable resin layer. By forming the adhesive layer as described, adhesiveness between the metal body of the fastener element and the printable resin layer can be improved or adhesiveness between the printable resin layer and another layer arranged on the surface of the printable resin layer can be improved, and the printing pattern carried out on the fastener element can be effectively prevented from being peeled off.

In addition, the manufacturing method of the fastener chain of the invention includes a process of forming the auxiliary resin layer on the exposed surface of the fastener element after forming the printable resin layer or before carrying out the printing by the inkjet method. As a result, a substantial thickness of the printable resin layer including the auxiliary resin layer increases to more reliably fix ink onto the printable resin layer (auxiliary resin layer) of the exposed surface. As a result, the desired pattern can be clearly and stably formed on the corresponding exposed surface.

Furthermore, the manufacturing method of the fastener chain of the invention includes a process of forming the protective layer on the exposed surface of the fastener element after carrying out the printing by the inkjet method. By forming the protective layer as described, since the fastener element itself can be protected or the pattern applied to the fastener element can be protected, the metal body of the fastener element or the printable resin layer can be prevented from being scratched and the durability of the printed pattern can be improved.

Further, the manufacturing method of the fastener chain of the invention includes a process of forming the plated layer having a color with higher reflectivity than the base portion, on the surface of the base portion of the fastener element. By forming the white-based or silver-based plated layer having higher reflectivity than the base portion of the fastener element, since a printing color of the printing carried out on the fastener element can further stand out, the printing pattern carried out on the fastener element can be more clearly viewed and further, the selection range of the color used in the printing of the fastener element can be expanded.

MODE(S) FOR CARRYING OUT THE INVENTION

Hereinafter, embodiments of the present invention will be described in detail with reference to the accompanying drawings. Further, the invention is not limited to the embodiments described below, but various changes can be made as long as the configurations are substantially equal to those in the invention and the similar operational advantages can also be obtained.

First Embodiment

Figure 1:
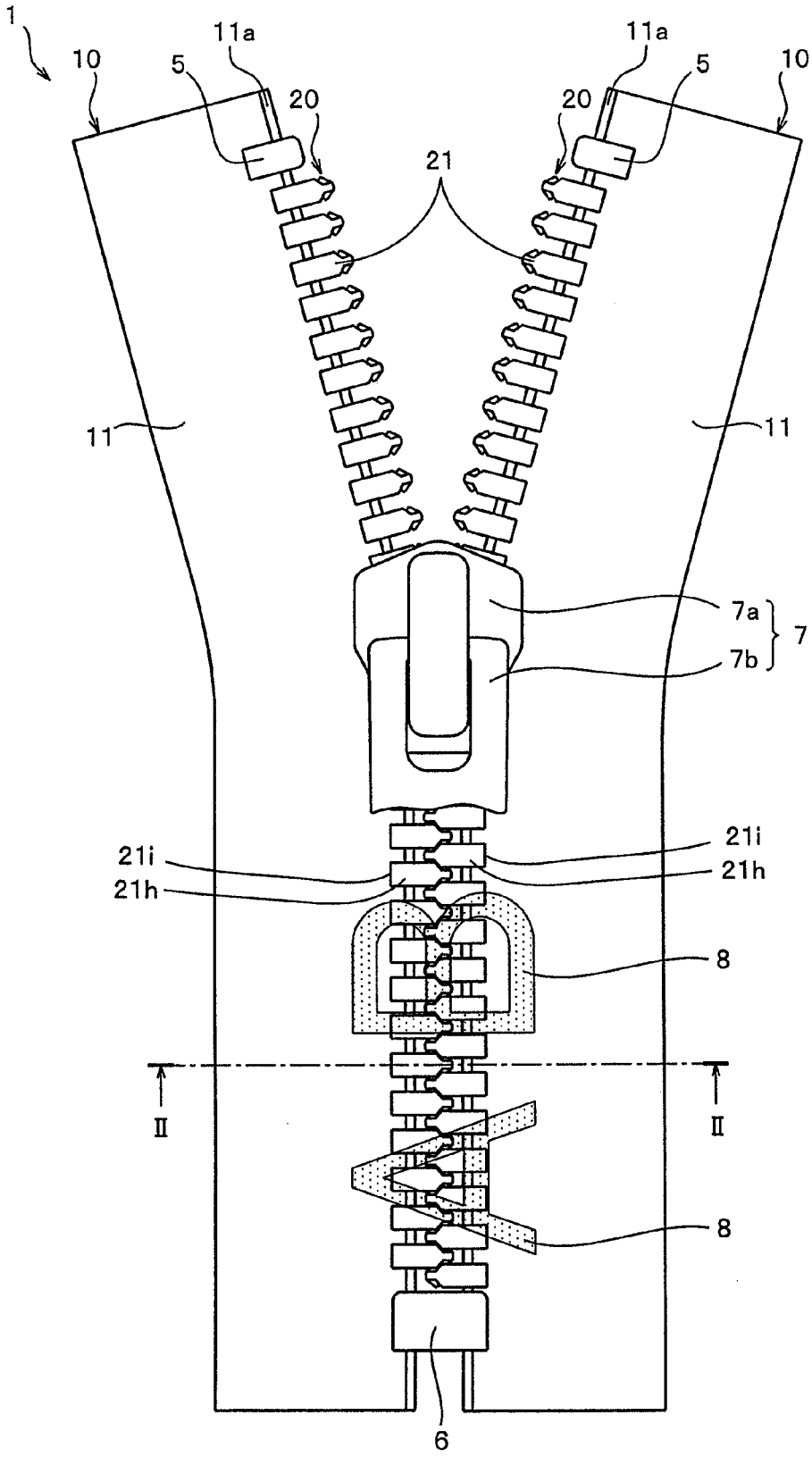
FIG. 1 is a front view of a slide fastener according to a first embodiment of the invention.
Figure 2:
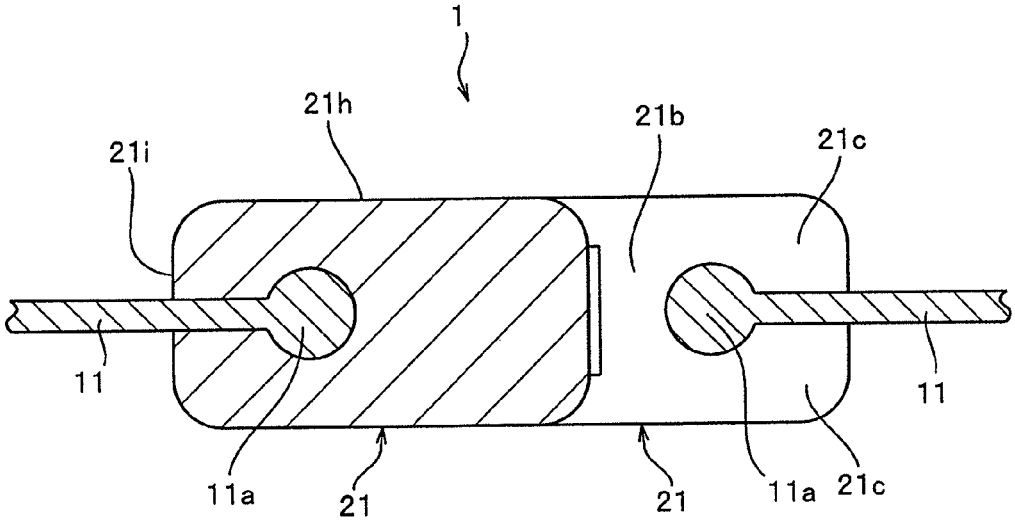
FIG. 2 is a cross-sectional view of line II-II illustrated in FIG. 1.
Figure 3:
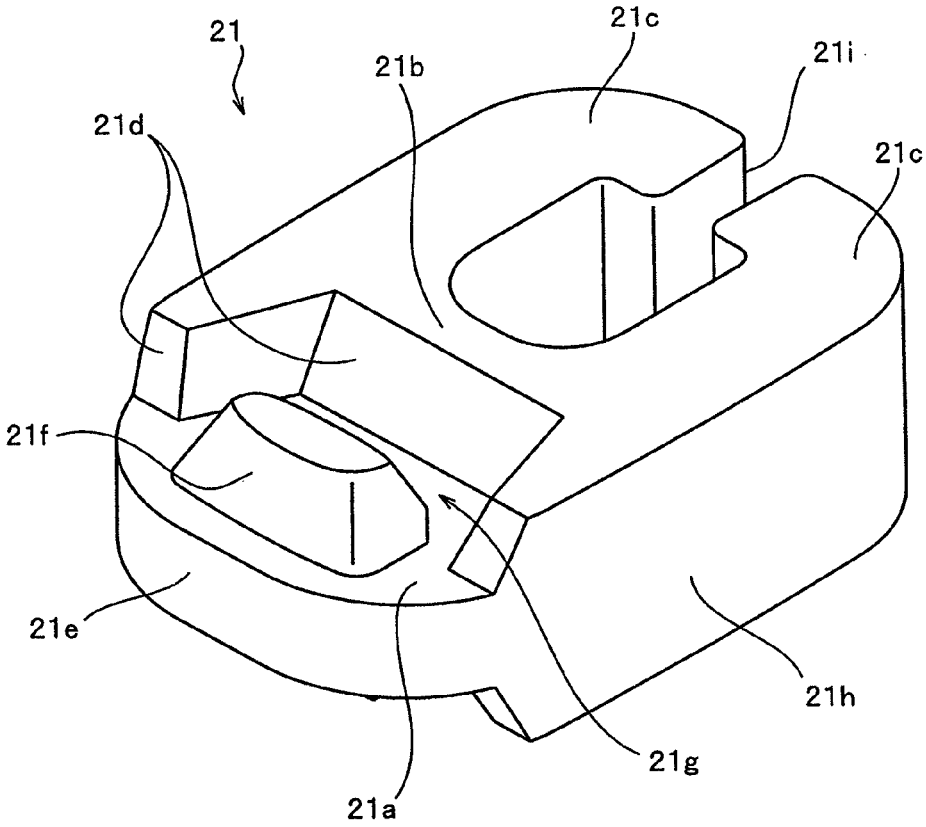
FIG. 3 is a perspective view illustrating a fastener element arranged in the slide fastener.
Figure 4:
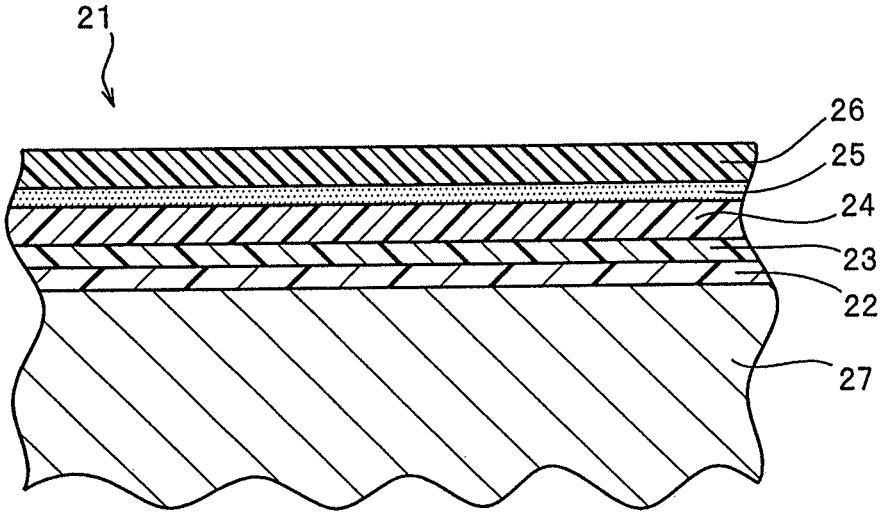
FIG. 4 is a cross-sectional view schematically illustrating a basic configuration of a layer formed on an exposed surface of the fastener element.
Figure 5:
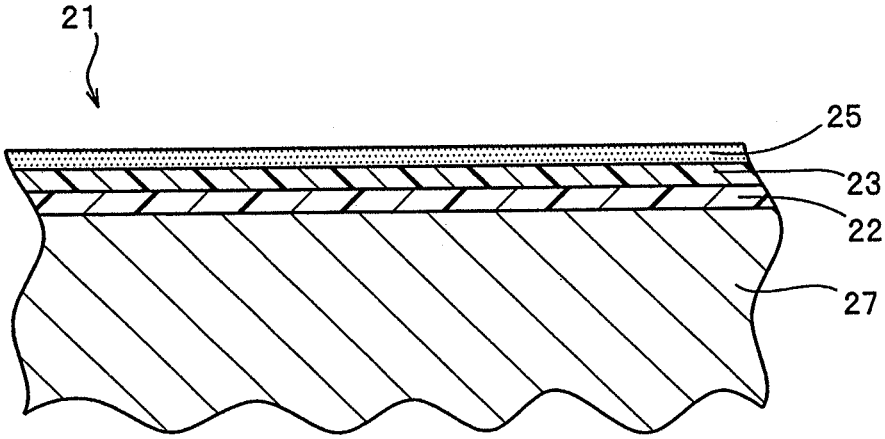
FIG. 5 is a cross-sectional view schematically illustrating a basic configuration of a layer formed on an inner side surface of the fastener element.

FIG. 1 is a front view of a slide fastener according to a first embodiment of the invention. FIG. 2 is a cross-sectional view of line II-II illustrated in FIG. 1. Further, FIG. 3 is a perspective view illustrating a fastener element arranged in the slide fastener. In addition, FIG. 4 and FIG. 5 are cross-sectional views illustrating basic configurations of layers formed on an exposed surface and an inner surface of the fastener element, respectively. In FIG. 4 and FIG. 5, each layer is schematically illustrated to have a certain amount of thickness in order to easily show a feature of the invention.

Further, in the following description, a front and rear direction represents a longitudinal direction of the fastener tape, and in particular, a direction to slide a slider to couple left and right element rows is set as a front direction, and a direction to slide the slider to separate the left and right element rows is set as a back direction. In addition, a left and right direction represents a tape width direction of the fastener tape, and in particular, a left side when the slide fastener is viewed from a front side as illustrated in FIG. 1 is set as a left direction, and a right side is set as a right direction. Further, an upper and lower direction represents a tape front and back direction of the fastener tape, and in particular, a side where a tab of the slider is arranged with respect to a tape surface of the fastener tape is set as an upper direction and an opposite side thereto is set as a lower direction.

A slide fastener 1 in a first embodiment includes a pair of left and right fastener stringers 10 having element rows 20 at opposing tape side edge portions, left and right first stops 5 (also referred to as a top stop) fixed to a front end side of the element row 20, a second stop 6 (also referred to as a bottom stop) fixed to a rear end side of the element row 20, and a slider 7 slidably attached along the element row 20.

The slide fastener 1 is configured so that the slider 7 slides forward to the first stop 5 to close the slide fastener 1 by coupling the left and right element rows 20. Further, the slide fastener 1 is configured so that the slider 7 slides backward to the second stop 6 to open the slide fastener 1 by separating the left and right element rows 20.

Further, the slider 7 arranged on the slide fastener 1 of the first embodiment has substantially the same configuration as a slider used in prior art. That is, the slider 7 in the first embodiment is provided with a slider body 7*a* and a tab 7*b* pivotably held on the slider body 7*a*. In addition, the slider body 7*a* includes upper and lower blades, a guide post connecting front end portions of the upper and lower blades, flanges extended to approach to each other from left and right side edges of the upper and lower blades, and a tab attaching post which stands on a top surface of the upper blade, and a substantially Y-shaped element guide path formed between the upper and lower blades.

Each of the left and right fastener stringers 10 of the first embodiment includes a fastener tape 11 and a plurality of metallic fastener elements 21 attached to the tape side edge portion opposed to the fastener tape 11, and a continuous pattern 8 (alphabet letters in the case of the first embodiment) is applied to the fastener elements 21 in a coupled state and the left and right fastener tapes 11.

In the first embodiment, each of the left and right fastener tapes 11 includes a tape main body woven in a band shape having a small width and sewn to a fastener attached product, and a tape side edge portion (also referred to as an element attaching portion) arranged at one side edge side of the tape main body, to which the plurality of fastener elements 21 is attached. Further, a core thread portion 11*a* is provided at the tape side edge portion opposed to the fastener tape 11. The core thread portion 11*a* has a swelling shape and is woven and knitted integrally with the fastener tape 11.

The plurality of metallic fastener elements 21 is attached to the tape side edge portion including the core thread portion 11*a* of the fastener tape 11 at a predetermined interval along a tape longitudinal direction by caulking processing, and as a result, the element rows 20 are formed. Further, a configuration of the fastener tape 11 is not particularly limited in the invention, and for example, a material or a thickness of each thread line configuring the fastener tape 11 may be arbitrarily set and further, the fastener tape 11 may be configured by a knitting structure.

Each fastener element 21 attached to the fastener tape 11 is formed by punching a metal plate (referred to as a rectangular wire material) having a rectangular cross section in a predetermined shape as well as pressing the metal plate with a punch and a dice, as described below. The fastener element 21 formed in the predetermined shape by the above configuration is attached to the tape side edge portion by caulking both leg portions 21*c* in a direction to approach each other with the tape edge of the fastener tape 11 interposed between a pair of leg portions 21*c* to be described below.

Further, in the invention, a means or a method of forming the fastener element 21 is not particularly limited and may be arbitrarily selected. For example, the fastener element 21 may be formed in such a manner that a wire material having a substantially Y-shaped cross section is formed by performing rolling processing of a long metallic wire material in multi-stages, a substantially Y-shaped element material is formed by sequentially cutting the wire material at a desired thickness in a longitudinal direction, and further, a coupling head 21*a* is formed by locally pressing and transforming one end portion of the material.

Further, the fastener element 21 attached to the fastener tape 11 includes an coupling head 21*a* arranged at an outer end portion of a tape, a body portion 21*b* having a predetermined thickness, which is extended to the inner side of the tape from the coupling head 21*a* through a stepped portion 21*d*, and a pair of leg portions 21*c* which are extended further to the inner side of the tape from the body portion 21*b*, and has a symmetric shape to the longitudinal direction (front and rear direction) of the tape, as shown in FIG. 3. The coupling head 21*a* includes a thin flat plate portion 21*e* arranged at the center in the front and rear direction, a coupling convex portion 21*f* that protrudes in the front and rear direction from the flat plate portion 21*e*, and a coupling concave portion 21*g* provided to be concave between the coupling convex portion 21*f* and the body portion 21*b*.

In this case, as a material of the fastener element 21, metal such as copper, copper alloy (for example, copper-zinc alloy), or aluminum may be used and particularly, when rigidity, cost, and processability of the fastener element 21 are considered, it is preferable that the copper or the copper alloy is used.

In the first embodiment, in a case where the material of the fastener element 21 is made of yellow or red yellow copper or a copper alloy, a metal body 27 of the fastener element 21 has a base portion made of copper or a copper alloy which becomes a raw material of the fastener element 21, and a plated layer arranged on the surface of the base portion and having a color with higher reflectivity than the base portion, in order to more clearly express the printed pattern 8 when the printing by the inkjet method is carried out on the corresponding fastener element 21.

Particularly, in this case, the metal body 27 of the fastener element 21 may have a white-based or silver-based plated layer. As such white-based or silver-based plated layer is arranged on the fastener element 21, as a result, the printed pattern 8 carried out on the fastener element 21 more clearly shows up and a selection range of colors used for the printing in the fastener element 21 may be expanded.

Here, the white-based or silver-based color includes a milky white color, a silvery white color, a grayish white color, or a white color or a silver color to which a subtle color such as a yellow color or a light blue color is thinly added, in addition to just the white color. Further, a material of the white-based or silver-based plated layer may include metal such as a copper-tin alloy, a tin-nickel alloy, nickel, chrome, palladium, rhodium, platinum, or the like, but in terms of cost or color, it is preferable to use alloy of copper, tin, and zinc adjusted by a predetermined composition.

Further, in the first embodiment, an adhesive layer 22 and a printable resin layer 23 are arranged on the entire surface (that is, the entire surface of the plated layer) of the metal body 27 of the fastener element 21, as illustrated in FIG. 4 and FIG. 5. The adhesive layer 22 and the printable resin layer 23 are formed by so-called barrel painting as described below.

In this case, the adhesive layer 22 is arranged to improve an adhesive property between the metal body 27 of the fastener element 21 and the printable resin layer 23. In the first embodiment, the adhesive layer 22 is made of an epoxy resin having an excellent adhesive property, and has a film thickness in the range of 0.1 to 5 μm and preferably a film thickness in the range of 0.5 to 1 μm.

Further, the printable resin layer 23 is arranged to stably fix ink when printing is carried out. In the first embodiment, the printable resin layer 23 is made of a transparent acrylic resin or acryl-urethane resin, and has a film thickness in the range of 0.1 to 5 μm and preferably a film thickness in the range of 0.5 to 1 μm.

Further, since the acrylic resin or acryl-urethane resin has excellent processability, the acrylic resin or acryl-urethane resin may make it difficult for a crack or fracture to occur on the printable resin layer 23 even though bending is carried out in order to caulk the fastener element 21 to the fastener tape 11. In the invention, the acrylic resin represents a synthetic resin having an acryl group and includes an acryl resin or a methacryl resin. Further, the aryl-urethane resin represents a synthetic resin generated by reacting with an acryl-polyol compound and an isocyanate compound.

Further, in the invention, for example, it is also possible to form the adhesive layer 22 on the printable resin layer 23 without forming the adhesive layer 22 between the metal body 27 of the fastener element 21 and the printable resin layer 23, or it is possible to form the adhesive layers 22 between the metal body 27 of the fastener element 21 and the printable resin layer 23, and on the printable resin layer 23, respectively.

By forming the adhesive layer 22 on the printable resin layer 23 as above, it is possible to improve adhesiveness between the printable resin layer 23 and an auxiliary resin layer 24 to be described below and further, for example, in a case where a film thickness of the printable resin layer 23 is small, improvement in adhesiveness between the metal body 27 of the fastener element 21 and the printable resin layer 23 may be obtained.

Further, in the fastener element 21 of the first embodiment, in a case where the tape surface of the fastener tape 11 on which the printing by the inkjet method is carried out is set as a first tape surface, and an exposed surface (in particular, a surface exposed in a tape front and back direction in a state of a fastener chain in which the left and right element rows 20 are coupled) exposed to the first tape surface side of the tape front and back direction of the fastener element 21 is set as an exposed surface 21*h* of the fastener element 21, the auxiliary resin layer 24 to improve fixability of ink is arranged at least on the printable resin layer 23 of the exposed surface 21*h* at the first tape surface side of the fastener element 21, as illustrated in FIG. 4.

The auxiliary resin layer 24 is formed by applying the synthetic resin onto the exposed surface 21*h* of the fastener element 21 by means of a roller in the state of the fastener chain in which the left and right fastener stringers 10 are coupled, as will be described below. Further, since the auxiliary resin layer 24 may just be arranged at least on the printable resin layer 23 of the exposed surface 21*h*, the auxiliary resin layer 24 may be arranged on the printable resin layer 23 of an inner surface 21*i* (a side surface of the leg portion 21*c* side) at the first tape surface side facing the tape inner side of the fastener element 21, for example.

In this case, the auxiliary resin layer 24 is arranged in order to increase a substantial thickness of the printable resin layer 23 for the ink to be fixed. In the first embodiment, the auxiliary resin layer 24 is made of the transparent acrylic resin or acryl-urethane resin, and has a film thickness in the range of 0.1 to 5 μm and preferably a film thickness in the range of 0.5 to 1 μm. The auxiliary resin layer 24 is arranged at least on the exposed surface 21*h* of the fastener element 21, as a result, fixability (dyeability) of ink attached onto the exposed surface 21*h* may be improved.

As the auxiliary resin layer 24 is formed on the exposed surface 21*h* of the fastener element 21 which is easily viewed from the outside at the time of using the slide fastener 1 to improve the fixability of the ink, the printed pattern 8 in the fastener element 21 is viewed more clearly and further improves an appearance of the slide fastener 1. Further, in the invention, materials of the adhesive layer 22, the printable resin layer 23, and the auxiliary resin layer 24 may be arbitrarily changed as necessary.

Further, in the first tape surface side of the fastener element 21, an ink layer 25 formed by ejecting ink from a nozzle head 30 of a printing apparatus is arranged at portions where printing is carried out on the surface of the auxiliary resin layer 24 in a part where the auxiliary resin layer 24 is arranged (for example, the exposed surface 21*h*), and the surface of the printable resin layer 23 in a part where the auxiliary resin layer 24 is not arranged (for example, the inner surface 21*i* of the fastener element 21 facing the tape inner side), as illustrated in FIG. 4 and FIG. 5.

In particular, in the case of the first embodiment, when the printing by the inkjet method is carried out, since the ink is ejected from the nozzle head be inclined in an advance direction of the nozzle head 30 as described below, the ink layer 25 may be stably formed on even the inner surface 21*i* of the fastener element 21 facing the tape inner side.

Further, a protective layer 26 which is an outermost layer is arranged at least on the ink layer 25 of the exposed surface 21*h* in the first tape surface side of the fastener element 21, as illustrated in FIG. 4. The protective layer 26 is formed by applying a synthetic resin on the exposed surface 21*h* of the fastener element 21 by means of the roller in the state of the fastener chain, and has a film thickness in the range of 0.1 to 5 μm and preferably a film thickness in the range of 0.5 to 1 μm. The protective layer 26 is provided to protect the fastener element 21 itself and to protect the ink layer 25 of the exposed surface 21*h*.

In this case, a material of the protective layer 26 is not particularly limited, but may adopt an acrylic resin, an acrylurethane resin, an epoxy-urethane resin, or a polyester resin in terms of durability or weather resistance. Further, since the protective layer 26 may just be arranged at least on the ink layer 25 of the exposed surface 21*h*, for example, the protective layer 26 may be arranged on the ink layer 25 of the inner side surface 21*i* of the fastener element 21.

As described above, in the fastener element 21 of the first embodiment, at a portion on the exposed surface 21*h* of the first tape surface side where printing is carried out, five layers of the adhesive layer 22, the printable resin layer 23, the auxiliary resin layer 24, the ink layer 25, and the protective layer 26 are arranged on the metal body 27, as illustrated in FIG. 4. Further, at a portion on a surface other than the exposed surface 21*h* of the first tape surface side (for example, the inner surface 21*i*) where printing is carried out, three layers of the adhesive layer 22, the printable resin layer 23, and the ink layer 25 are arranged on the metal body 27, as illustrated in FIG. 5.

Further, since the ink layer 25 is not formed at a portion of the fastener element 21 where printing is not carried out, four layers of the adhesive layer 22, the printable resin layer 23, the auxiliary resin layer 24, and the protective layer 26 are arranged on the metal body 27 in the exposed surface 21*h* and further, two layers of the adhesive layer 22 and the printable resin layer 23 are arranged on the metal body 27 on a surface other than the exposed surface 21*h* (for example, the inner surface 21*i*).

The left and right first stops 5 in the first embodiment are manufactured by sequentially cutting a long metal line having a U-shaped cross section in a longitudinal direction at a desired thickness or cutting a plate-like metal line in a longitudinal direction at a desired thickness and bending an obtained cut piece in a U-shape. The first stop 5 having the U-shaped cross section is attached to the fastener tape 11 by carrying out bending for plastic-deforming both ends of the first stop 5 in an approaching direction with the fastener tape 11 interposed between both ends of the first stop 5.

The second stop 6 in the first embodiment is manufactured by sequentially cutting a long metal line having an X-shaped or H-shaped cross section in a longitudinal direction with a desired thickness and includes a body portion and arm portions that are extended one set each to right and left from the body portion. The second stop 6 is attached throughout the left and right fastener tapes 11 by carrying out bending for plastic-deforming one set of arm portions in an approach direction to each other with the left and right fastener tapes 11 respectively interposed between one set of arm portions.

Figure 6:
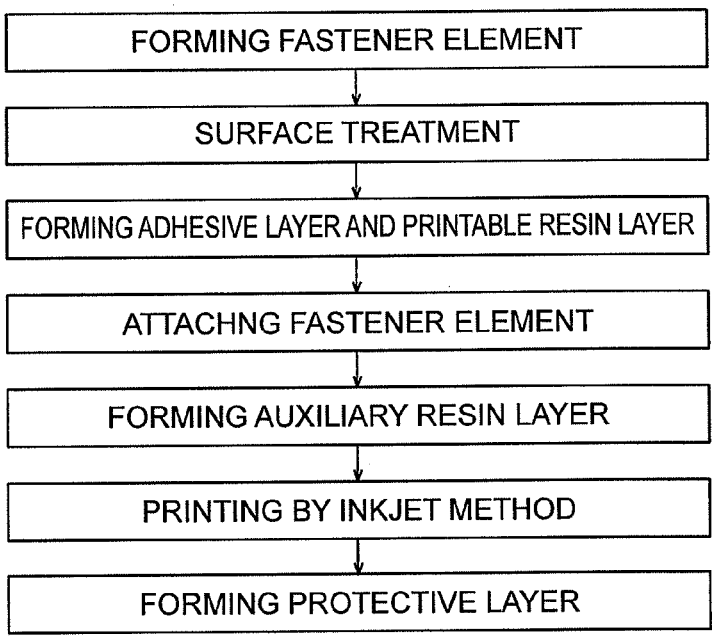
FIG. 6 is a flowchart illustrating a manufacturing method of a fastener chain according to the first embodiment of the invention.

Subsequently, a method for manufacturing the slide fastener 1 of the first embodiment, having the above configuration will be described with reference to a flowchart illustrated in FIG. 6.

First, the fastener tape 11 and a plurality of metallic fastener elements 21 are prepared. For example, a carrier bar reciprocates and a weft yarn is inserted into an opening of a warp by using a weaving machine, and as a result, the fastener tape 11 is woven by a desired weaving structure.

Further, the fastener element 21 is formed in a predetermined shape separately from the fastener tape 11. In detail, first, a long metal plate (rectangular wire material) having a rectangular cross section is prepared and a pressings is carried out plurality of times of on the metal plate by using a punch and the metal plate is punched to be formed in a predetermined shape by using a dicer.

Subsequently, surface treatment is carried out on the fastener element 21 formed as above. In the first embodiment, as the surface treatment of the fastener element 21, base grinding processing (barrel grinding processing), chemical grinding processing, and plating processing are sequentially carried out. First, in the base grinding processing, the fastener element 21 and a grinding whetstone are put into a barrel and thereafter, by rotating the barrel, a concave-convex portion formed on an outer surface of the fastener element 21 are grinded. After the base grinding processing is done, the fastener element 21 is recovered from the inside of the barrel.

Next, in the chemical grinding processing, the base-grinded fastener element 21 is immersed in a chemical grinding solution containing hydrogen peroxide or sulfuric acid for a predetermined time to grind a minute concave-convex portion which remains on the outer surface of the fastener element 21. After the chemical grinding processing is done, the fastener element 21 is extracted from the chemical grinding solution, and cleaning and acidizing processing are carried out.

Further, in the plating processing, a white or silver-based plating layer is evenly formed on the chemical-grinded fastener element 21 with a predetermined thickness. In this case, a forming method of a plating film is not particularly limited and may adopt wet plating processing or dry plating processing. For example, as the wet plating processing, electroplating or hot-dip plating may be used and meanwhile, as the dry plating processing, a PVD method or a CVD method may be used.

Subsequently, first barrel painting is carried out on the fastener element 21 which is subjected to the above surface treatment, in order to form the adhesive layer 22 on the surface of the metal body 27 of the fastener element 21. In the first barrel painting, the fastener element 21 subjected to the surface treatment is put into the barrel and further, an epoxy resin is ejected while rotating the barrel. As a result, the adhesive layer 22 may be evenly formed on the entire surface of the metal body 27 of the fastener element 21. After the first barrel painting is done, the fastener element 21 is recovered from the inside of the barrel.

Continuously, second barrel painting is carried out on the fastener element 21 having the adhesive layer 22 in order to form the printable resin layer 23. In the second barrel painting, the fastener element 21 is put into the barrel and further, an acrylic resin or an acryl-urethane resin is ejected while rotating the barrel. As a result, the printable resin layer 23 may be evenly formed on the entire surface of the fastener element 21. After the second barrel painting is done, the fastener element 21 is recovered from the inside of the barrel.

Further, in the invention, the forming method of the adhesive layer 22 or the formation of the printable resin layer 23 is not particularly limited, and if the adhesive layer 22 or the printable resin layer 23 may be formed on the entire surface of the fastener element 21, other methods, for example, such as a method of immersing the fastener element 21 in a synthetic resin, and the like may be used.

Subsequently, the fastener element 21 having the adhesive layer 22 and the printable resin layer 23 is attached to the fastener tape 11. In this case, the fastener element 21 may be attached by the same method as prior art. In detail, both leg portions 21*c* of the fastener element 21 are plastic-deformed by carrying out caulking in an approach direction to each other with a tape side edge portion of the fastener tape 11 interposed between a pair of leg portions 21*c* of the fastener element 21. As a result, the fastener element 21 is caulked to the tape side edge portion of the fastener tape 11 and a fastener stringer 10 is obtained.

In this case, since the adhesive layer 22 is arranged between the metal body 27 of the fastener element 21 and the printable resin layer 23, and further, the printable resin layer 23 is made of the acrylic resin or acryl-urethane resin having excellent processability, crack or fracture may be effectively prevented from occurring on the printable resin layer 23 even though caulking processing is carried out on the fastener element 21.

Further, the left and right fastener stringers 10 obtained as above are combined as one set and element rows 20 of the left and right fastener stringers 10 are coupled with each other to configure a fastener chain.

Subsequently, first roll painting is carried out on the fastener elements 21 of the obtained fastener chain which are coupled in order to form the auxiliary resin layer 24. In the first roll painting, a roller contacts the first tape surface side, in which printing of the fastener chain is carried out, from an upper part of the fastener element 21 to apply the acrylic resin or the acryl-urethane resin at least on an exposed surface 21*h* of the fastener element 21. As a result, the auxiliary resin layer 24 for improving fixability of ink is formed at least on the printable resin layer 23 of the exposed surface 21*h* of the fastener element 21.

Figure 7:
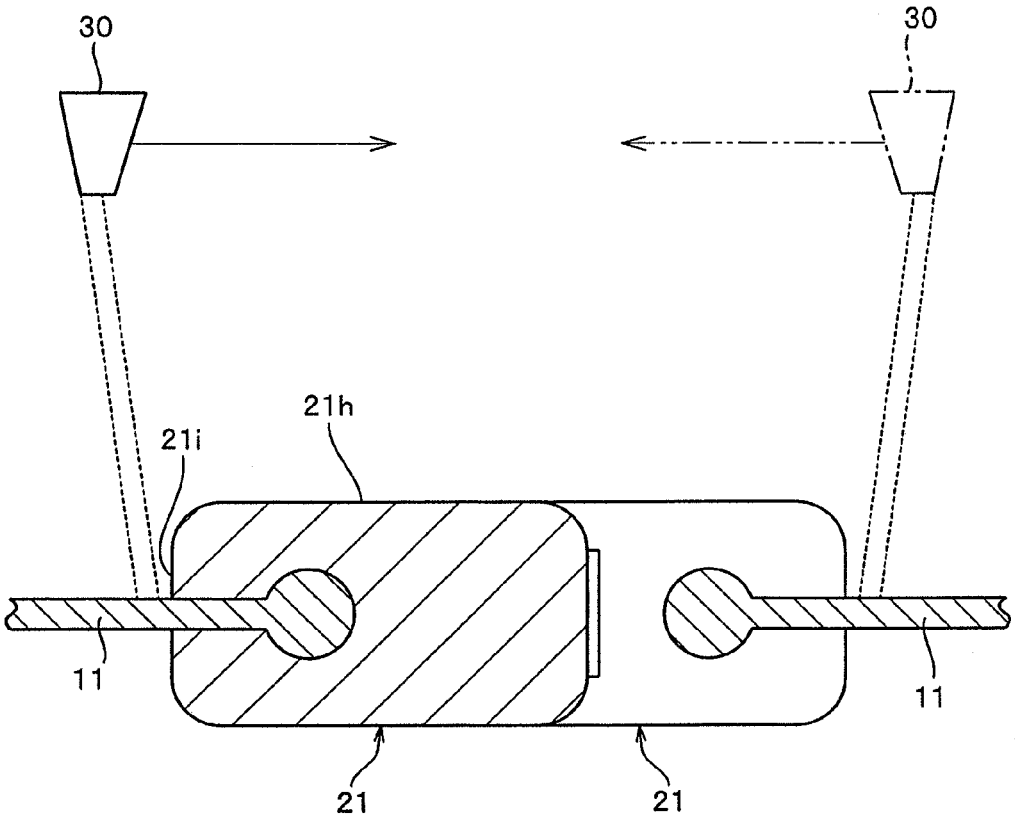
FIG. 7 is a schematic view describing a direction in which ink droplets are ejected from a nozzle head when printing by an inkjet method is carried out.

After the auxiliary resin layer 24 is formed in the fastener element 21 as described above, printing by the inkjet method is carried out on the fastener chain. In this printing process, the fastener chain is conveyed in a tape longitudinal direction at a predetermined speed, and as illustrated in FIG. 7, a nozzle head 30 of a printing apparatus reciprocates with respect to the fastener chain in a tape width direction and ink droplets made of disperse dyes are ejected toward the fastener chain from the nozzle head 30.

Particularly, in the first embodiment, ink is ejected from the nozzle head 30 while reciprocating at least once and preferably twice or more for each printable printing area with respect to the fastener chain by one tape width-direction movement of the nozzle head 30. As a result, as illustrated in FIG. 1, a desired pattern 8 (letters of alphabets) which is formed in a continuous manner may be easily applied to the fastener tape 11 and the fastener element 21.

Further, in the invention, a method of ejecting the ink droplets from the nozzle head 30 is not particularly limited, and may adopt, for example, a method of ejecting ink a state of minute droplets by applying ultrasonic vibration to ink, a method of ejecting the ink droplets by using a piezoelectric element, or a method of ejecting the ink droplets by generating bubbles in ink in a nozzle by heating.

In this case, in the first embodiment, the nozzle head 30 reciprocates with respect to the fastener chain in the tape width direction and ink is ejected in an ejection direction inclined in an advance direction of the nozzle head 30 rather than a directly downward direction of the nozzle head 30. That is, when the nozzle head 30 moves with respect to the fastener chain toward a right side of the tape width direction, ink is ejected in a direction inclined to a right side of the directly downward direction of the nozzle head 30, and further, when the nozzle head 30 moves with respect to the fastener chain toward a left side of the tape width direction, ink is ejected in a direction inclined to a left side of the directly downward of the nozzle head 30.

As a result, ink is ejected to a first tape surface of the fastener tape 11 and the auxiliary resin layer 24 on the exposed surface 21*h* of the fastener element 21, and ink may be reliably ejected on to even the printable resin layer 23 on the inner surface 21*i* of the fastener element 21. Further, in this case, ink may be ejected and fixed on to even the printable resin layer 23 on a part of an outer surface of a coupling head 21*a* side of the fastener element 21 depending on the thickness of the fastener tape.

Therefore, in the first embodiment, since the printing by the inkjet method is carried out on the fastener chain as described above, since it is possible to eject and fix ink onto even the inner surface 21*i* of the fastener element 21, the desired printing pattern 8 is prevented from being interrupted between the fastener tape 11 and the fastener element 21 and may be stably formed on the fastener chain. Further, in this case, since ink is fixed onto the printable resin layer 23 and the auxiliary resin layer 24 arranged in the fastener element 21, the printing pattern 8 on the fastener chain has excellent homochromy between the fastener tape 11 and the fastener element 21.

Further, in the printing by the inkjet method of the first embodiment, the printing may not carried out on a front surface and a rear surface of the fastener element 21 arranged to advance directly in the longitudinal direction of the tape. However, since the front surface and the rear surface of the fastener element 21 may not substantially viewed from the outside in a case of a form of the slide fastener 1, decorativeness and design of the slide fastener 1 does not deteriorate.

Further, in the printing by the inkjet method of the first embodiment, since clearness of the printing pattern 8 is excellent or tactility of the printed fastener tape 11 is excellent, disperse dye-based ink is used. However, in the invention, the printing by the inkjet method may be carried out by using dye-based ink other than the disperse dyes and further, the printing by the inkjet method may be carried out by using pigment-based ink.

Here, the pigment-based ink is a type of ink in which pigment is not dissolved in solvent but dispersed in the solvent, unlike the dye-based ink in which the dye is dissolved in the solvent. Even in the case where the printing by the inkjet method is carried out on the fastener chain by using the pigment-based ink, the ink droplets are stably fixed on to the fastener element 21 to form the pattern 8 which is formed in a continuous manner on the fastener tape 11 and the fastener element 21.

After the printing by the inkjet method is carried out as described above, heat treatment is carried out on the fastener chain to which the ink is fixed, and as a result, the ink permeates into a synthetic fiber of the fastener tape 11, or the auxiliary resin layer 24 and the printable resin layer 23 of the fastener element 21, and the printing pattern 8 is dyed to the fastener tape 11 and the fastener element 21. Further, in the first embodiment, the heat treatment is carried out, for example, by passing the fastener chain through a heated atmosphere, which is also referred to as dry heat treatment. Further, after the heat treatment is carried out, cleaning is carried out on the fastener chain in order to improve dyeing fastness of the fastener chain.

Subsequently, the second roll painting is carried out on the fastener chain which is subjected to the heat treatment and the cleaning in order to form the protective layer 26. In the second roll painting, the roller contacts the first tape surface side, in which printing of the fastener chain is carried out, from the upper part of the fastener element 21 to apply the synthetic resin at least on the exposed surface 21*h* of the fastener element 21. As a result, the protective layer 26 that protects the ink layer 25 is formed at least on the exposed surface 21*h* of the fastener element 21.

After the protective layer 26 is formed as described above, first and second stops 5 and 6, and a slider 7 are attached to the obtained fastener chain and further, the fastener tape 11 is cut in a predetermined length. As a result, the slide fastener 1 illustrated in FIG. 1 is configured.

In the slide fastener 1 of the first embodiment manufactured as above, the desired pattern 8 is stably printed on the first tape surface of the fastener tape 11, and at least on the exposed surface 21*h* and the inner surface 21*i* at the first tape surface side of the fastener element 21. In particular, in the slide fastener 1 of the first embodiment, the continuous pattern 8 is formed from the fastener tape 11 of the left fastener stringer 10 to the fastener tape 11 of the right fastener stringer 10 through the left and right fastener elements 21 which are in a coupled state, and high decorativeness and design unattainable in the slide fastener with the metallic fastener element in the prior art is obtained.

Second Embodiment

Figure 8:
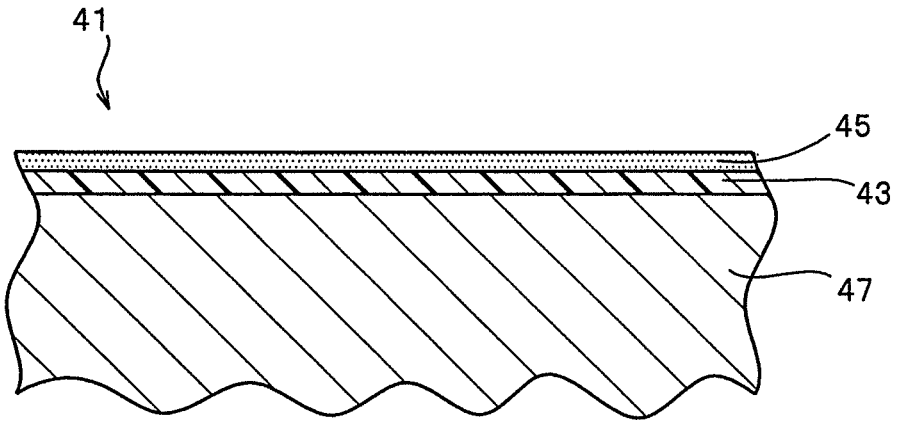
FIG. 8 is a cross-sectional view schematically illustrating a basic configuration of a layer formed on an exposed surface and an inner side surface of a fastener element in a second embodiment of the invention.

FIG. 8 is a cross-sectional view illustrating a basic configuration of a layer formed on an exposed surface and an inner surface of a fastener element of a slide fastener according to a second embodiment.

In the slide fastener according to the second embodiment, a printable resin layer 43 is formed on an entire surface of each fastener element 41 and thereafter, printing by an inkjet method is carried out on the fastener element 41 where the printable resin layer 43 is formed. That is, in the second embodiment, a configuration of the layer formed in the fastener element 41 is different from that of the fastener element 41 of the first embodiment, and a minimum configuration in which the printing by the inkjet method is carried out on the metallic fastener element 41 is described.

Further, in the second embodiment, the slide fastener of the embodiment is substantially the same as the slide fastener according to the first embodiment other than that the configuration of the layer formed in the fastener element 41 is different. Therefore, in the second embodiment, the configuration of the layer formed in each fastener element 41 is primarily described, and description will be omitted by using the same reference numerals that refer to parts and members having the same configuration of the slide fastener of the first embodiment.

The fastener element 41 of the second embodiment is made of metal, and a metal body 47 of the fastener element 41 includes a base portion made of copper or a copper alloy and a white-based or silver-based plated layer arranged on the surface of the base portion and having higher reflectivity than the base portion.

Further, the printable resin layer 43 formed by barrel painting is arranged on the entire surface of the metal body 47 of the fastener element 41 (that is, the entire surface of the plated layer) in order to stably fix ink to the fastener element 41. In this case, the printable resin layer 43 is made of a transparent acrylic resin or acryl-urethane resin.

Further, an ink layer 45 formed by the printing by the inkjet method is arranged on the printable resin layer 43 of the fastener element 41. In this case, the printing by the inkjet method is carried out similarly to the first embodiment. Further, in the second embodiment, at least one of adhesive layer 22, the auxiliary resin layer 24, and the protective layer 26 described in the first embodiment may be formed as necessary.

Even in the slide fastener of the second embodiment having the fastener element 41, a desired pattern is stably printed on a first tape surface of the fastener tape 11 and at least on an exposed surface and an inner surface at a first tape surface side of the fastener element 41 and decorativeness and design unattainable in the prior art is obtained.

Further, in the above first embodiment and the second embodiment, the case in which printing is carried out on the fastener tape 11 and the fastener elements 21 and 41 by using the inkjet method is described. However, in the invention, for example, the printable resin layers 23 and 43, and the like may be formed even on the first and second metallic stops 5 and 6 similarly to the fastener elements 21 and 41.

As a result, when the printing by the inkjet method is carried out on the fastener chain, printing may be carried out even on the first and second stops 5 and 6, that are attached to the fastener chain in advance. Further, in this case, the desired pattern which is formed in a continuous manner from the fastener tape 11 or the fastener elements 21 and 41 may be formed on the first and second stops 5 and 6, and decorativeness and design of the slide fastener may be further improved.

Further, in the first embodiment and the second embodiment, a case in which printing is carried out on the fastener tape 11 and the first tape surface sides of the fastener elements 21 and 41 by using the inkjet method is described. However, in the invention, the printing by the inkjet method is carried out not only on the first tape side surface but also a second tape surface side opposite to the first tape surface, and the desired pattern can be formed on both front and back surfaces of the fastener chain.

DESCRIPTION OF REFERENCE NUMERALS

1 Slide fastener
5 First stop

6 Second stop
7 Slider
7*a* Slider body
7*b* Tab
8 Pattern
10 Fastener stringer
11 Fastener tape
11*a* Core thread portion
15 Fastener chain
20 Element row
21 Fastener element
21*a* Coupling head
21*b* Body portion
21*c* Leg portion
21*d* Stepped portion
21*e* Flat plate portion
21*f* Coupling convex portion
21*g* Coupling concave portion
21*h* Exposed surface
21*i* Inner side surface
22 Adhesive layer
23 Printable resin layer
24 Auxiliary resin layer
25 Ink layer
26 Protective layer
27 Metal body
30 Nozzle head
41 Fastener element
43 Printable resin layer
45 Ink layer
47 Metal body

The invention claimed is:

1. A fastener stringer, comprising:

a plurality of metallic fastener elements attached to tape side edge portions of a fastener tape, wherein ink is printed on a portion of a first tape surface side of the fastener tape and a portion of the fastener elements, wherein for each of the fastener elements:

the fastener element includes at least one printable resin layer which is capable of fixing the ink, and is formed on an entire surface of the fastener element, and the portion of the fastener element includes an exposed surface which is exposed in a tape front and back direction and is on a same side of the fastener tape as the first tape surface side and an inner side surface which is on the same side of the fastener tape as the first tape surface side and which faces a tape inward side.

2. The fastener stringer according to claim 1, wherein:

the printable resin layer is made of an acrylic resin or an acryl-urethane resin.

3. The fastener stringer according to claim 2, wherein:

an adhesive layer formed on the entire surface of the fastener element is provided between a metal body of the fastener element and the printable resin layer or on a surface of the printable resin layer.

4. The fastener stringer according to claim 1, wherein:

an adhesive layer formed on the entire surface of the fastener element is provided between a metal body of the fastener element and the printable resin layer or on a surface of the printable resin layer.

5. The fastener stringer according to claim 4, wherein:

the adhesive layer is made of an epoxy resin.

6. The fastener stringer according to claim 1, wherein:

an auxiliary resin layer is formed at least on the printable resin layer of the exposed surface of the fastener element.

7. The fastener stringer according to claim 6, wherein:

the auxiliary resin layer is made of an acrylic resin or an acryl-urethane resin.

8. The fastener stringer according to claim 1, wherein:

a protective layer is formed at least on an outermost layer of the exposed surface of the fastener element.

9. The fastener stringer according to claim 1, wherein:

a metal body of each of the fastener elements includes a base portion of the fastener element and a plated layer arranged on a surface of the base portion and having a color with higher reflectivity than the base portion.

10. The fastener stringer according to claim 9, wherein:

the plated layer is formed by an alloy layer of copper, tin, and zinc.

11. A fastener chain including a pair of left and right fastener stringers according to claim 1.

* * * * *